United States Patent [19]

Wiblin

[11] 4,355,947

[45] Oct. 26, 1982

[54] HOOK-TYPE CARRIAGE PLATE WITH FLOATING FORKS

[75] Inventor: Wayne T. Wiblin, Ashtabula, Ohio

[73] Assignee: Towmotor Corporation, Mentor, Ohio

[21] Appl. No.: 892,055

[22] Filed: Mar. 31, 1978

Related U.S. Application Data

[63] Continuation-in-part of Ser. No. 648,442, Jan. 12, 1976, abandoned.

[51] Int. Cl.[3] ..... B66C 3/00

[52] U.S. Cl. ..... 414/785; 403/408; 414/664

[58] Field of Search ..... 414/785, 623, 660–672; 403/408

[56] References Cited

U.S. PATENT DOCUMENTS

| | | | |
|---|---|---|---|
| 2,178,367 | 10/1939 | Dunham | 414/667 |
| 2,282,201 | 5/1942 | Neuman | 414/785 |
| 2,709,016 | 5/1955 | Schenkelberger | 414/623 |
| 2,822,101 | 2/1958 | Schenkelberger | 414/667 |
| 3,066,807 | 12/1962 | Draxler | 414/667 |
| 3,356,241 | 12/1967 | Varilek | 414/785 |
| 3,780,896 | 12/1973 | Crausford | 414/785 |
| 3,974,927 | 8/1976 | Schuster | 414/667 |
| 4,002,256 | 1/1977 | Kroboth | 414/785 |
| 4,050,599 | 9/1977 | Bender | 414/785 |

FOREIGN PATENT DOCUMENTS

| | | | |
|---|---|---|---|
| 252118 | 2/1957 | Austria | 414/785 |
| 959267 | 2/1957 | Fed. Rep. of Germany | 414/785 |

*Primary Examiner*—Galen L. Barefoot
*Assistant Examiner*—R. B. Johnson
*Attorney, Agent, or Firm*—Phillips, Moore, Weissenberger, Lempio & Majestic

[57] ABSTRACT

A standard hook-type carriage assembly designed for lift truck use in the handling of palletized cargo is converted for use in the handling of concrete blocks by hooking block-handling forks on the carriage plate and positioning such forks on the carriage plate with predetermined lateral spacings between the forks by a removable elongated spacer bar to which all of the forks are attached. Lost-motion connections are made between the forks and the spacer bar and limited lengthwise movement of the spacer bar relative to the carriage plate is permitted so that the forks can float, relative to each other and in unison, laterally along the carriage plate. The forks can also move independently of each other through a limited vertical distance relative to the carriage plate.

1 Claim, 6 Drawing Figures

FIG. 4.
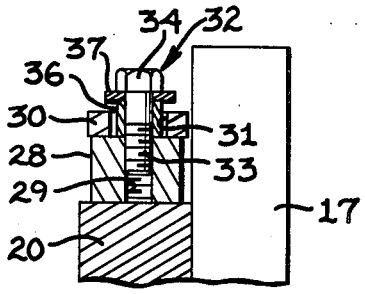
FIG. 5.
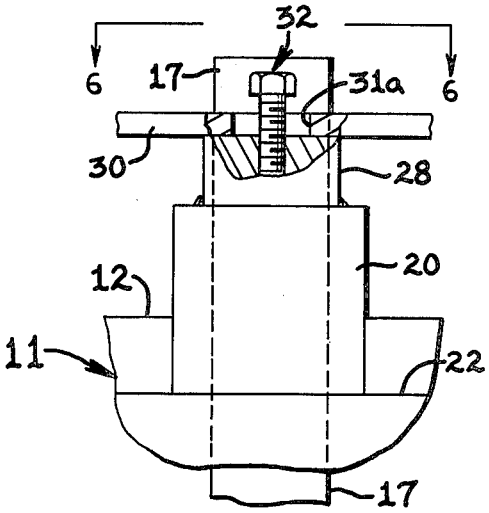
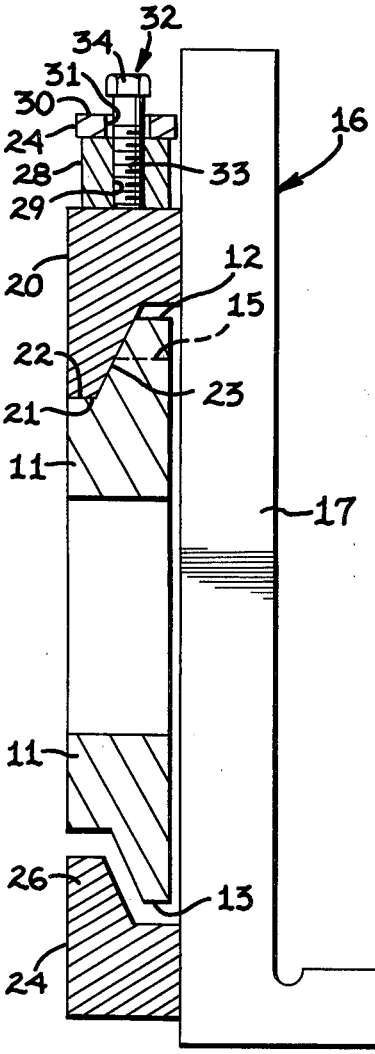
FIG. 3.
FIG. 6.
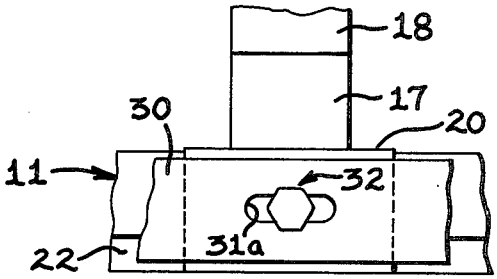

HOOK-TYPE CARRIAGE PLATE WITH FLOATING FORKS

CROSS-REFERENCE TO RELATED APPLICATION

The present application is a continuation-in-part of application Ser. No. 648,442, filed Jan. 12, 1976, and now abandoned.

BACKGROUND OF THE INVENTION

The present invention relates to a carriage assembly for a lift truck and pertains more particularly to a carriage assembly having a hook-type carriage frame designed for the handling of palletized cargo but with concrete-block handling forks floatingly mounted thereon.

Cargo-handling lift trucks normally include a carriage assembly comprising a carriage frame and one or more forwardly extending forks mounted on the frame, the carriage frame in turn being mounted on the mast uprights of the truck for vertical translatory movement. In use, the truck is maneuvered so that the forks extend under, or into openings in, the load, the load being then lifted by elevation of the carriage assembly.

In general, there are two types of carriage assemblies—the hook type and the shaft type.

Hook-type carriage assemblies are normally used for the handling of palletized cargo and the like. In such assemblies the carriage frame includes a generally vertical carriage plate, the forks being hooked at their upper and lower ends onto the plate so that the forks cannot pivot about their upper ends. The carriage plate includes a generally horizontal guide member, typically a horizontal track surface, so that the forks can be slid therealong to their desired locations on the plate. Latch means are typically provided to latch the forks to the carriage plate at selected lateral positions along the plate. When so latched, the forks are relatively rigidly attached to the plate so as not to be movable relative to the plate or to each other. The selected positions along the carriage plate at which the forks can be latched thereto are located so as to provide fork spacings compatible with standard pallets. Such spacing is normally incompatible with the spacing requirements when unpalletized concrete blocks are to be handled. Because of the relatively rigid attachment of the forks to the carriage plate and the incompatibility of the fork spacings, hook-type carriage assemblies are not normally satisfactory for the handling of concrete blocks or the like.

In the event that concrete blocks are to be handled, shaft-type carriage assemblies are normally used. In such carriage assemblies, the carriage frame is provided with a horizontal shaft to serve as a guide member, and the forks of the assembly are mounted on the shaft by means of a sleeve at their upper end which surrounds the shaft. In such an arrangement, the forks can move relatively freely along the shaft and can also pivot about the axis of the shaft. The movement of the forks, relative to the carriage frame and to each other, which is permitted in the shaft-type carriage assembly, makes such assembly particularly adaptable to the handling of concrete blocks.

In the handling of cargo it is frequently necessary to switch from the handling of palletized cargo to the handling of blocks, or vice versa. If the economics of the situation do not justify the use of two lift trucks, one with a carriage assembly for pallets and the other with a carriage assembly for blocks, then the entire carriage assembly must be removed from the mast uprights and replaced with another carriage assembly as the character of the cargo changes. Such change of a carriage assembly is tedious and time-consuming. It is expensive both in labor costs and in the capital investment required for two separate and complete assemblies.

Accordingly, there is a definite need for an improved carriage assembly that provides a floating fork arrangement for block-handling use while using a carriage frame normally designed for the handling of palletized loads. With such an arrangement, the carriage frame can be left in place on the lift truck mast uprights and only the forks need to be changed to convert from one use to the other.

SUMMARY OF THE INVENTION

The present invention is directed to fulfilling the need set forth above.

In more particular, the present invention provides an improvement in a carriage assembly for use in a lift truck, wherein the assembly includes a carriage frame having a generally horizontal guide member integral therewith and a plurality of forks slidably mounted on the guide member, the improvement being that a separate and elongated spacer bar is disposed adjacent to the forks with the forks being each secured to the spacer bar at predetermined points along the length thereof.

In further particular, each fork is attached to the spacer bar by a lost-motion connection so that each fork can have a limited floating movement on the carriage frame in a direction along the length of the spacer bar.

Also in further particular, the spacer bar is movable through a limited distance lengthwise thereof relative to the carriage frame so that the forks have a limited floating movement in unison along the carriage frame.

Also in further particular, the forks are mounted on the carriage frame and secured to the spacer bar for independent vertical movement through a limited distance to provide for limited relative vertical movement of the fork tips.

Further aspects of the invention will be set forth in the course of the following detailed description.

BRIEF DESCRIPTION OF THE DRAWINGS

In the drawings forming a part of this application and in which like parts are designated by like reference numerals throughout the same.

FIG. 3 is a sectional view of the carriage assembly of FIG. 2, taken along line 3—3 thereof;

FIG. 4 is a view, partly in section, and similar to the upper portion of FIG. 3, illustrating a modification of the invention;

FIG. 5 is a rear elevational view of an upper portion of a carriage assembly embodying the present invention and illustrating another modification thereof;

FIG. 6 is a view of the modification of FIG. 5, as seen from the line 6—6 thereof.

DESCRIPTION OF THE PREFERRED EMBODIMENTS

Figure 1:
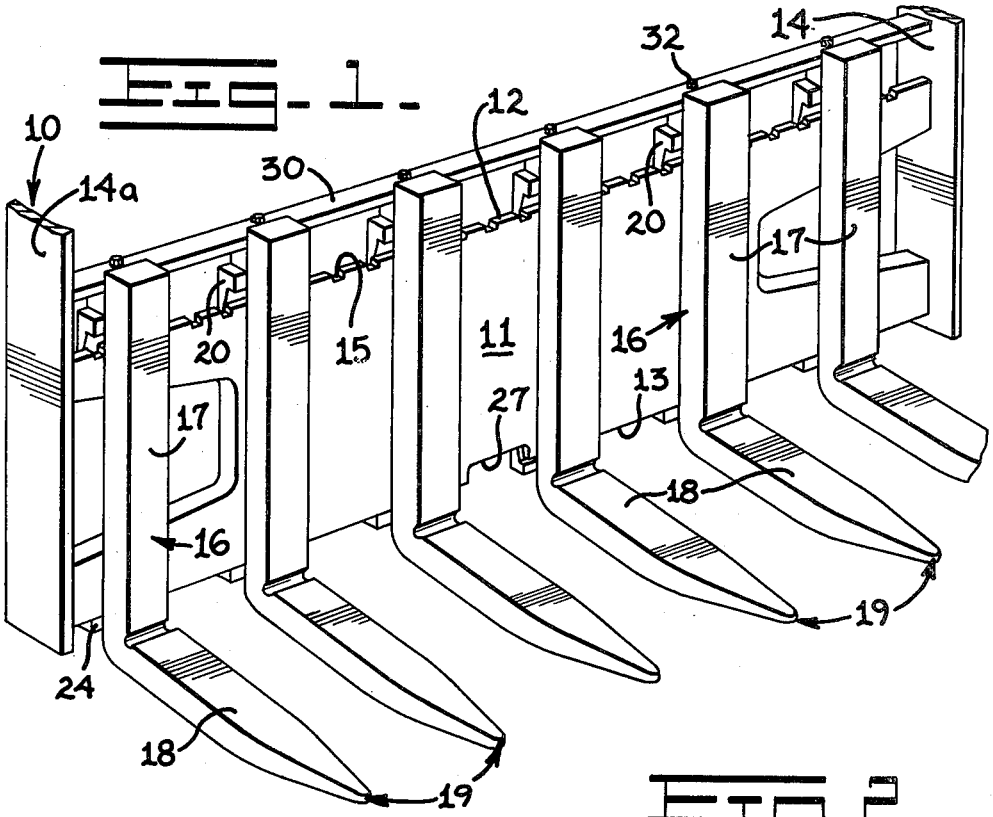
FIG. 1 is a perspective view of a carriage assembly embodying the present invention.

Turning now to FIG. 1 of the drawings, there is illustrated a standard hook-type carriage assembly, having a frame generally designated by the reference numeral 10, which frame includes as an integral part thereof a vertically disposed carriage plate 11 having an upper edge 12 and a lower edge 13. Frame 10 also includes a pair of vertically extending end rails 14 and 14*a* secured to the ends of the carriage plate to support a conventional back rest (not shown). A plurality of index notches 15 are provided along the upper portion of plate 11 for conventional positioning of pallet forks along the length of the carriage plate. For purposes of simplicity, the conventional mast uprights and interconnections between the carriage frame 10 and the uprights is not shown.

FIG. 1 is also illustrative of hook-type fork assemblies, indicated by the numeral 16, each fork assembly 16 being mounted on the carriage plate 11 and including a horizontal leg 18 extending from the lower end of the vertical leg forwardly from the carriage plate. The specific fork assemblies 16 as illustrated herein which are designed for block-handling will include a rounded point or tip 19.

Figure 2:
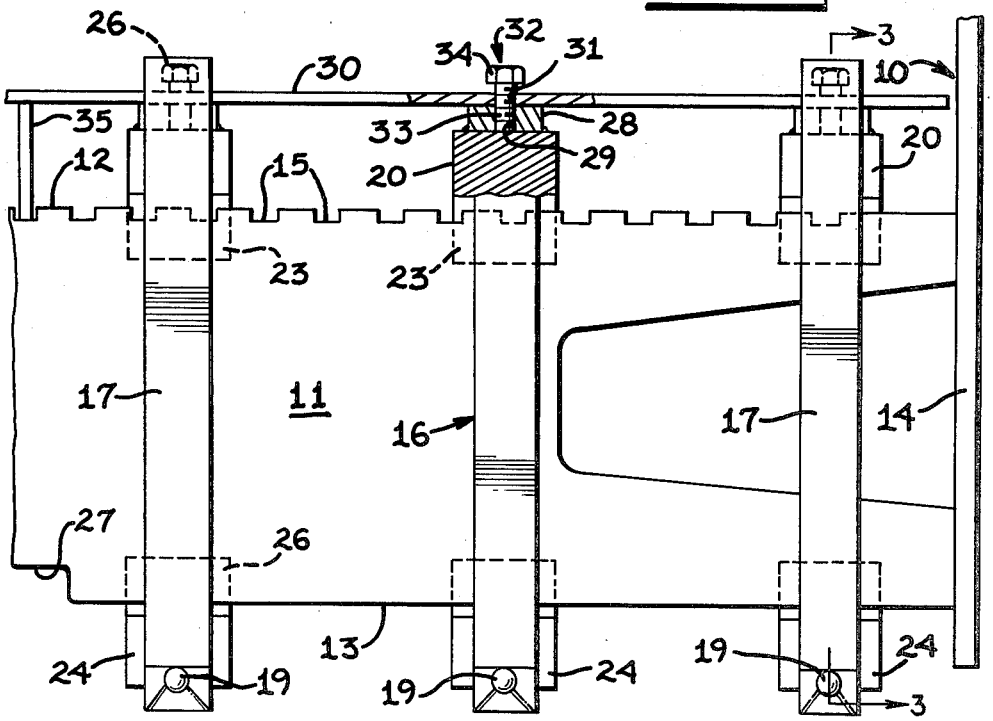
FIG. 2 is a front elevational view of a portion of the carriage assembly of FIG. 1.

As best seen in FIGS. 2 and 3, hook-type fork assemblies 16 further include an upper hook 20 secured to the upper end of the vertical leg 17, the hook extending rearwardly across the upper edge 12 of the carriage plate and downwardly with the down-facing hook surface 21 being in sliding engagement with the upwardly facing horizontal track 22 which extends along the upper portion of the carriage plate and forms a guide member integral with frame 10, and with the vertically inclined hook surface 23 engaging the back side of the carriage plate. Hook 20 thus supports the fork assembly on the carriage plate, with the fork assembly being laterally slidable along the plate.

A lower hook 24 is secured to the lower end of fork leg 17, such hook extending rearwardly across the lower edge 13 of the carriage plate and then upwardly behind the plate, the upwardly extending portion 26 of hook 24 being engageable with the back side of the carriage plate 11 to prevent excessive outward pivoting of the fork about the upper edge of the plate.

Carriage plate 11 is conventionally provided with a removal notch 27 at its lower edge, notch 27 having a width somewhat greater than the width of a lower hook 24 and extending upwardly sufficiently so that the lower hook 24 may pass therethrough when the upper hook 20 is placed on or removed from the carriage plate.

In the conventional use of a hook-type pallet fork arrangement, suitable latch means are provided at the upper ends of each fork for engagement with the index notches 15 for specifically locating and maintaining each of the forks in a particular position along the carriage plate. For example, latch means as shown in U.S. Pat. No. 4,002,256 may be used for this purpose. With the conventional arrangement, the forks are secured in selected positions in accordance with the pallets to be handled and are permitted little or no lateral movement along the carriage plate.

In using the disclosed conventional carriage plate to handle concrete blocks and the like, the normal pallet forks (generally two in number) are removed, one at a time, by unlatching a fork, sliding it along the carriage plate until the lower hook 24 is positioned at the removal notch 27, pivoting the lower hook through the notch, and lifting the fork off the plate.

Forks 16, designed for block-handling use and as illustrated herein, are then mounted one by one on the carriage plate 11 and slid along horizontal track 22 to the generally desired position. In the drawings, six such forks are shown, to enable stacks of concrete blocks, six wide, to be handled at a time. Each fork assembly is provided with a block 28 fixed to the upper end of the upper hook 20 thereof, each block having a threaded bore 29 down thereinto. An elongated spacer bar 30, is then laid along the blocks 28 in parallelism with guide member 22, spacer bar 30 having a plurality of bores or apertures 31 extending vertically therethrough and at predetermined points along the spacer bar, such apertures 31 being spaced apart in accordance with the size of the particular blocks to be handled. Suitable pin means, such as bolts 32 having threaded body portions 33, are then extended through the spacer bar apertures and threaded into the threaded block bores 29. The length of the block bores 29 and the length of the bolts 32 are selected so that the bolt heads 34 are spaced above the upper surface of the spacer bar 30 when the bolts are fully threaded into the block bores. As is apparent, apertures 31 and bolts 32 provide means for securing each of the fork assemblies to the spacer bar at predetermined points along the length of the spacer bar to position the fork assemblies on the guide member 22 with the spacing between the fork assemblies in a direction along the length of the guide member 22 being determined by the spacing between the predetermined points along the length of the spacer bar.

The bolts 32 are undersized relative to the apertures 31, i.e,, the diameters of the bolt body portions 33 are less than the diameters of the apertures, to permit a limited amount of relative movement between the bolt and aperture in a direction along the length of the spacer bar, such limited amount of movement being equal to the total clearance between the bolt body and aperture.

Additionally, spacer bar 30 is not directly attached to carriage plate 11 and can move through a limited lengthwise distance relative to the carriage plate. End rails 14 and 14*a*, which are in the path of lengthwise movement of the spacer bar, serve as a limit mean to provide stops for such movement, the distance between the end rails being somewhat greater than the length of the spacer bar so that the difference provides for a predetermined distance of lengthwise movement of the spacer bar. Such movement of the spacer bar thus allows the forks to shift along the length of the carriage plate in unison with the spacer bar.

If end rails 14 and 14*a* are not used, a stub 35, fixed to spacer bar 30, may be used to depend downwardly into one of the index notches 15 of the carriage plate, stub 35 being narrower than the notch width to serve as a limit means to allow a limited lateral movement of the spacer bar 30 along the carriage plate.

Thus, with either arrangement, the block-lifting forks 16 are permitted a limited lateral floating movement along the carriage, in unison by the lateral movement of spacer bar 30 relative to the carriage, and relative to each other by the lost-motion connection of each fork to the spacer bar. Such movement greatly facilitates the insertion of the forks into the core holes of the blocks.

Further, and as best shown in FIG. 3, the lower hook 24 is spaced from the upper hook 20 to provide a predetermined amount of vertical clearance between the lower hook and the carriage plate. Such clearance thus enables the forks to move upwardly relative to the carriage plate by an amount equal to the clearance so that the tips 19 can move vertically for easier insertion into the core holes of the concrete blocks being handled. The clearances between the bolt heads 34 and spacer bar 30 enable one fork to move upwardly and carry the spacer bar 30 upwardly therewith but without causing a lifting of the other forks. Additionally, the clearance between the lower hook and carriage plate, together with the lost-motion connections of the forks to the spacer bars, enables each fork to have a limited and independent amount of swinging, pendulum movement about the upper hook, both in a plane parallel to the plane of the carriage plate and also in a plane perpendicular to the carriage plate, again for better accommodation to the load.

The illustrated carriage assembly can be changed back easily to the handling of palletized loads by removing bolts 32 so that the spacer bar 30 can be removed from the forks. The block-lifting forks 16 are then removed from the carriage plate and latch-type pallet forks are remounted thereon.

Turning now to FIG. 4, the vertical spacing between the head 34 of bolt 32 and the upper surface of spacer bar 30 may be provided by means of a sleeve 36 having a predetermined length exceeding the thickness of the spacer bar, which sleeve is fitted onto the cylindrical body portion 33 of the bolt. A suitable washer 37 may also be fitted upon the bolt. This arrangement provides a definite spacing of the head of the bolt and the washer above the upper surface of the spacer bar to permit free movement of the fork along the carriage plate and relative to the spacer bar to the extent permitted by the overall clearance between sleeve 36 and the spacer bar aperture 31.

FIGS. 5 and 6 disclose another modification wherein the spacer bar 30 is provided with elongated apertures or slots 31*a* to increase the lost-motion movement of the forks along the carriage plate relative to the spacer bar and thereby allow the spacing between individual forks to vary to a greater degree in order to accommodate themselves to the block spacing.

The above-described embodiments provide an effective and easy conversion of a standard hook-type carriage plate from use with detent-type hook forks fixedly latched to the plate at a predetermined lateral distance therebetween to use with hook-type forks having a semi-floating lateral and vertical movement relative to the carriage and relative to different predetermined mean lateral distances. Investment costs are minimized since the owner of a standard hook-type carriage assembly for handling of palletized cargo need only acquire the fork assemblies needed for the handling of blocks and a spacer bar having apertures located relative to the particular blocks to be handled.

If desired, the spacer bar 30 could have two or more sets of apertures spaced therealong, with the spacing between apertures in each set being designed for a particular size block. In such case, the same spacer bar could be used for several different-sized concrete blocks. However, since the spacer bar is relatively inexpensive and since a plurality of sets of apertures might give rise to confusion as to which apertures should be used, it is preferable to provide a separate spacer bar for each size of block, with each spacer bar being designed in accordance with the blocks to be handled so that the aperture spacing matches the block openings and the aperture shape and size and the spacer bar length is such as to provide the proper degree of fork float.

While the invention has been described by means of specific embodiments, it is to be understood that numerous changes and modifications may be made therein without departing from the spirit and scope of the invention as defined in the appended claims.

The embodiments of the invention in which an exclusive property or privilege is claimed are defined as follows:

1. A carriage assembly for use on a lift truck, comprising:

a hook-type carriage plate having upper and lower edges, a front, an upwardly facing horizontal track extending along the upper portion of said plate to form a horizontal guide member integral with said carriage plate, and a plurality of index notches along the upper edge of said plate, a plurality of fork assemblies each having a vertical leg, a forwardly extending lower horizontal leg, and a rearwardly and downwardly extending upper hook secured to the upper end of said vertical leg, each fork assembly being mounted on said carriage plate for lateral sliding movement along said carriage plate, with said vertical leg being adjacent the front of said carriage plate and with said hook extending rearwardly across said upper edge of said carriage plate and down into sliding engagement with said track, an elongated spacer bar separate from said carriage plate and removably positioned adjacent said fork assemblies in parallelism with said track, securing means for securing said spacer bar solely to said fork assemblies and for securing said fork assemblies to said spacer bar at predetermined points along the length of said spacer bar to position said fork assemblies along said track with the spacing between said fork assemblies in a direction along the length of said track being determined by the spacing between said predetermined points along the length of said spacer bar, limit means for permitting said spacer bar to move lengthwise relative to said carriage plate and for preventing said spacer bar from moving lengthwise relative to said carriage plate more than a predetermined distance, said limit means comprising a stub secured to said spacer bar and extending into one of said index notches of said carriage plate, said stub being undersized relative to said notch.

* * * * *